United States Patent [19]

Bischof

[11] Patent Number: 4,906,115

[45] Date of Patent: Mar. 6, 1990

[54] APPARATUS FOR ADJUSTING THE MINIMUM PRINT HEAT TO PLATEN SPACING IN A PRINTER

[75] Inventor: Stefan Bischof, Ulm-Jungingen, Fed. Rep. of Germany

[73] Assignee: Mannesmann Aktiengessellschaft, Dusseldorf, Fed. Rep. of Germany

[21] Appl. No.: 248,488

[22] Filed: Sep. 23, 1988

[30] Foreign Application Priority Data

Sep. 23, 1987 [EP] European Pat. Off. ..... 87730110.1

[51] Int. Cl.[4] ..... B41J 11/20

[52] U.S. Cl. ..... 400/55; 400/59; 400/354.3

[58] Field of Search ..... 400/55, 57, 59, 56, 400/58, 352, 354, 354.3, 355, 356

[56] References Cited

U.S. PATENT DOCUMENTS

| | | | |
|---|---|---|---|
| 4,286,888 | 9/1981 | Bennett et al. | 400/55 |
| 4,720,200 | 1/1988 | Gomoll et al. | 400/59 |
| 4,784,503 | 11/1988 | Bettini | 400/59 |

FOREIGN PATENT DOCUMENTS

| | | | |
|---|---|---|---|
| 154091 | 8/1985 | Japan | 400/55 |
| 213178 | 9/1986 | Japan | 400/55 |

OTHER PUBLICATIONS

"Snap Fastener for Blind Installations"; *IBM Technical Disclosure Bulletin;* vol. 30, No. 2, pp. 519–520; Jul. 1987.

*Primary Examiner*—David A. Wiecking

*Attorney, Agent, or Firm*—Cohen, Pontani & Lieberman

[57] ABSTRACT

A printer includes a platen (3), a print head (7) and a front carriage guide shaft (4) for supporting the print head and adjustable for selectively varying the print head-to-platen spacing. The guide shaft is mounted to the printer frame by an eccentric (11) and a setting lever (12) secured to the eccentric is selectively movable for adjusting the print head-to-platen spacing. A detent plate (13) is mounted to the printer frame (1, 2) and carries stops (14, 15) for limiting movement of the setting lever and, therefore, the print head-to-platen spacing adjustment. Releaseably engageable lock elements (16) on the detent plate and frame provide relative adjustability and retention of the position of the detent plate on the frame for setting the position of the front limit stop (15) and, thereby, the minimum permitted print head-to-platen spacing obtainable through movement of the setting lever.

14 Claims, 5 Drawing Sheets

APPARATUS FOR ADJUSTING THE MINIMUM PRINT HEAT TO PLATEN SPACING IN A PRINTER

FIELD OF THE INVENTION

The present invention relates to devices such as dot-matrix printers and, more particularly, to printers having means for setting the minimum distance or spacing between a print head and a paper-supporting platen.

BACKGROUND OF THE INVENTION

It is well known in conventional printers, such for example as dot matrix printers, to provide the user with the ability to readily adjust the spacing between the print head and the platen which operatively supports the paper or other material on which printing is to occur. This adjustment enables paper or forms or the like of a relatively wide range of thicknesses to be accomodated by the printer. There is also, however, a "base setting" which corresponds to the minimum permissable distance or spacing between the print head and platen and beyond which the user may not normally adjust the print head-to-platen spacing. For example, a dot-matrix wire print head may have an operating stroke of the printing wires of about 0.2 to 0.5 mm. In such a case, a minimum print head-to-platen spacing of less than 0.2 mm would prevent proper operation of the printer and the user, in adjusting such spacing to accomodate various thicknesses of paper, must therefore be prevented from adjusting the spacing to less than that minimum amount. Thus, after such a "basic setting" has been effected by the manufacturer, the user cannot make this minimum spacing any smaller.

For example, in the Mannesmann-Tally printer model MT-140, the carriage guide shaft is guided in slide blocks which are disposed on the sideplates of the printer frame. To adjust the basic setting of the print head-to-platen spacing, the carriage guide shaft is relatively moved toward or away from the platen. With the basic setting adjustment completed, the carriage guide shaft is permanently bolted to the sideplates. This arrangement thus requires cumbersome, labor intensive and therefore expensive, and potentially inaccurate assembly and adjustment. In addition, the adjustment is prone to unintended change and, therefore, loss of the setting by loosening of the guide shaft securing bolts as a result of vibrations occurring during normal printer operation.

SUMMARY OF THE INVENTION

It is the desideratum of the invention to provide an arrangement for adjusting and retaining the basic setting of a printer that overcomes the various deficiencies of prior art arrangements. It is a particular object of the invention to provide such an arrangement by which the basic setting adjustment may be carried out rapidly, easily and accurately, is positively and reliably retained against loss of the setting, and which employs a minimum of operating and cooperating parts.

These objects are achieved, in accordance with the invention, in an arrangement wherein the front carriage guide shaft is rotatably mounted in each of the sideplates by eccentrics, wherein the setting or user-operable spacing adjustment lever is mounted to the front carriage guide shaft outside of one sideplate, wherein a detent plate carrying a rear stop and a front stop for the setting lever is associated with the setting lever on the sideplate, and wherein the detent plate, after loosening of a lock between the detent plate and sideplate, is selectively displaceable within a guide through an acute angle around the horizontal axis of the carriage guide shaft to adjust the relative position of the detent plate front stop and, thereby, the minimum print head-to-platen spacing. Accordingly, in addition to the setting lever this arrangement requires only a single structural part, namely the detent plate, which operatively combines several functions. The detent plate is now thus employed for two different functions—on the one hand, the basic setting is adjusted by selectively displacing the detent plate and, on the other hand, the user can selectively adjust the print head-to-platen spacing to conform to the thickness or number of layers of paper by moving the cooperating setting lever. Retention of the minimum spacing, or so-called basic setting, is assured.

Another improvement provided by the invention is that the detent plate, on its end surface, has a radial toothing for the adjustment to the thickness of paper and that the radial toothing faces at least one detent tooth on the setting lever. In accordance with another feature of the invention, the engagement between the sideplate and detent plate for achieving and retaining the basic setting is formed by a toothing provided on a limiting edge of an arcuate opening in the sideplate and by a mating toothing provided on the detent plate, said mating toothing being arranged on a spring-mounted lever arm of the detent plate. These engaged parts can therefore be readily released and re-engaged as necessary or desired.

Other objects and features of the present invention will become apparent from the following detailed description considered in conjunction with the accompanying drawings, of a currently preferred embodiment of the invention. It is to be understood, however, that the drawings are designed solely for purposes of illustration and not as a definition of the limits of the invention, for which reference should be made to the appended claims.

BRIEF DESCRIPTION OF THE DRAWINGS

In the drawing, wherein similar reference characters denote similar elements throughout the several views.

DETAILED DESCRIPTION OF THE PREFERRED EMBODIMENT

Figure 1:
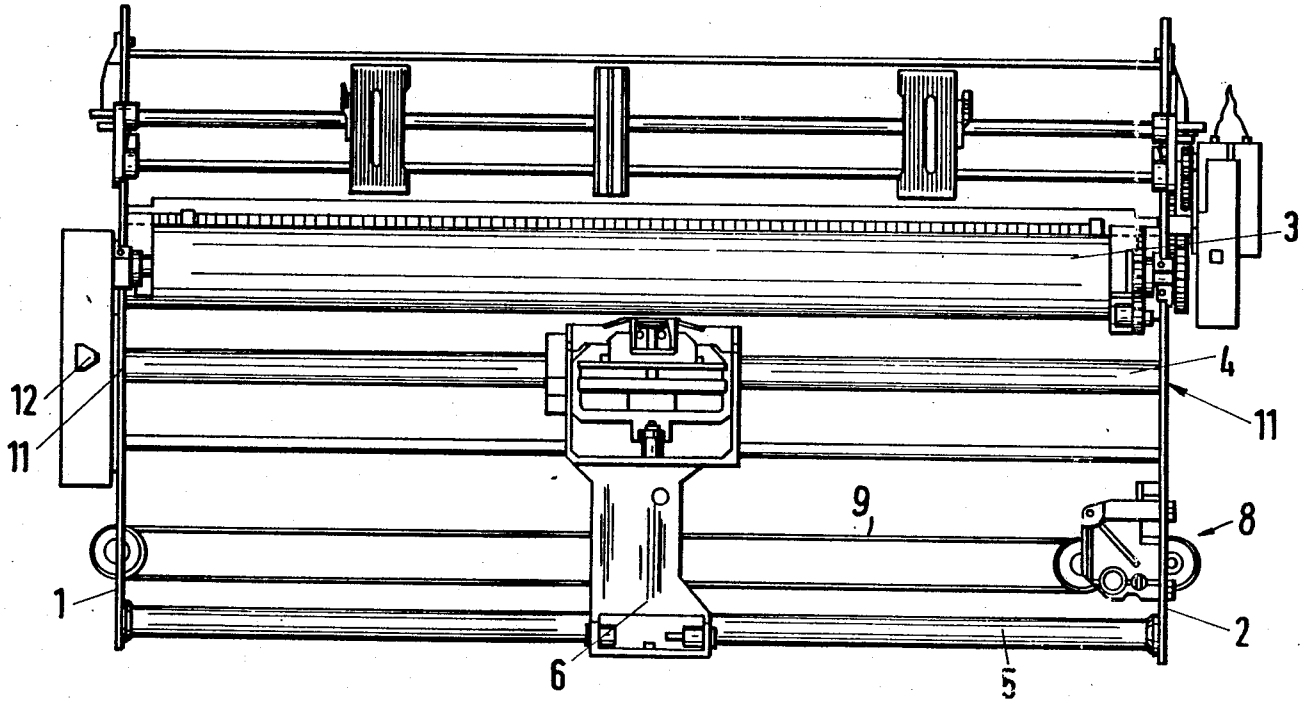
FIG. 1 is a top plan view of a printer frame without housing.

A printer frame consists of spaced apart sideplates 1, 2 and spanningly between which a platen 3, a front carriage guide shaft 4 and a rear carriage guide shaft 5 are disposed. A carriage 6 having a print head 7 is guided on and along the , guide shafts 4, 5 over a path of movement in front of the platen 3. The carriage 6 is reciprocatingly driven between the sideplates 1, 2 by means of a rope or belt drive which includes a rope or belt. The print head 7 has its printing elements supported at a basic distance 10 from the surface of the recording support which, in use, lies directly on the platen 3.

Figure 2:
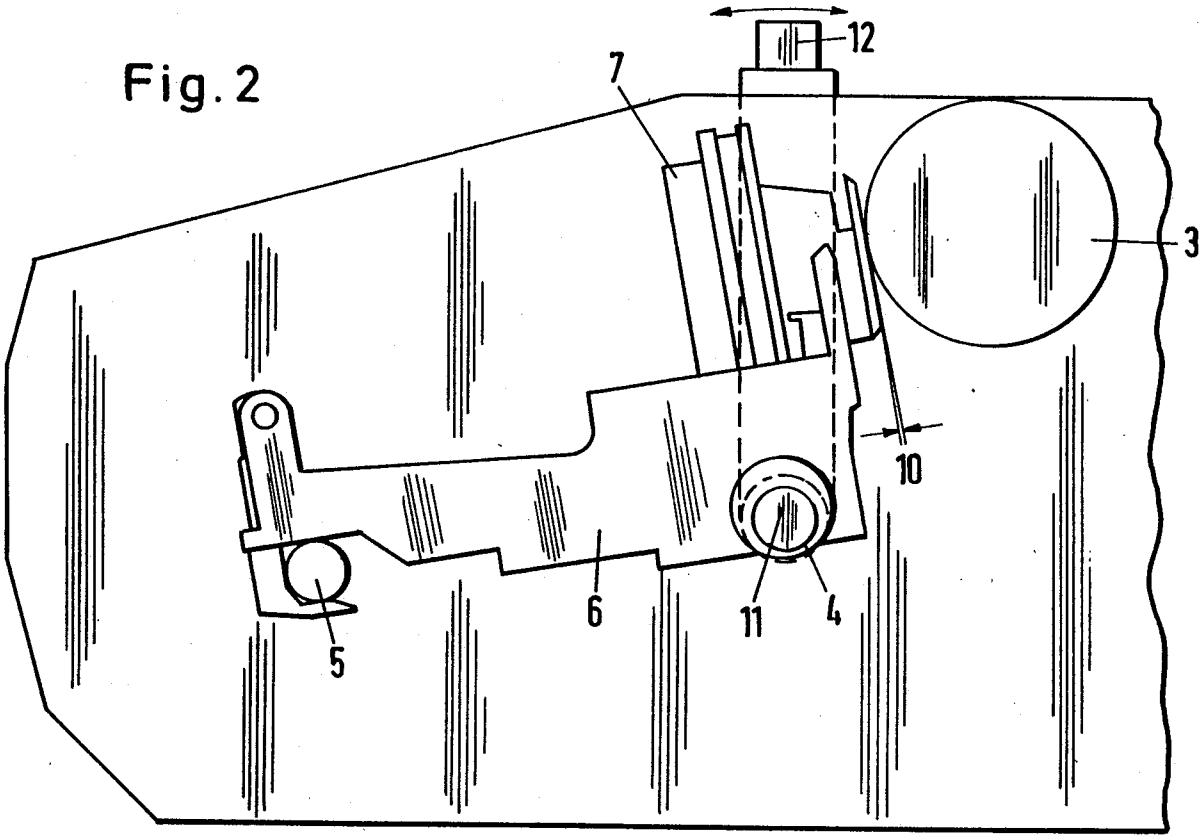
FIG. 2 is a right-hand side view of a portion of the printer frame, shown in an enlarged scale.
Figure 4:
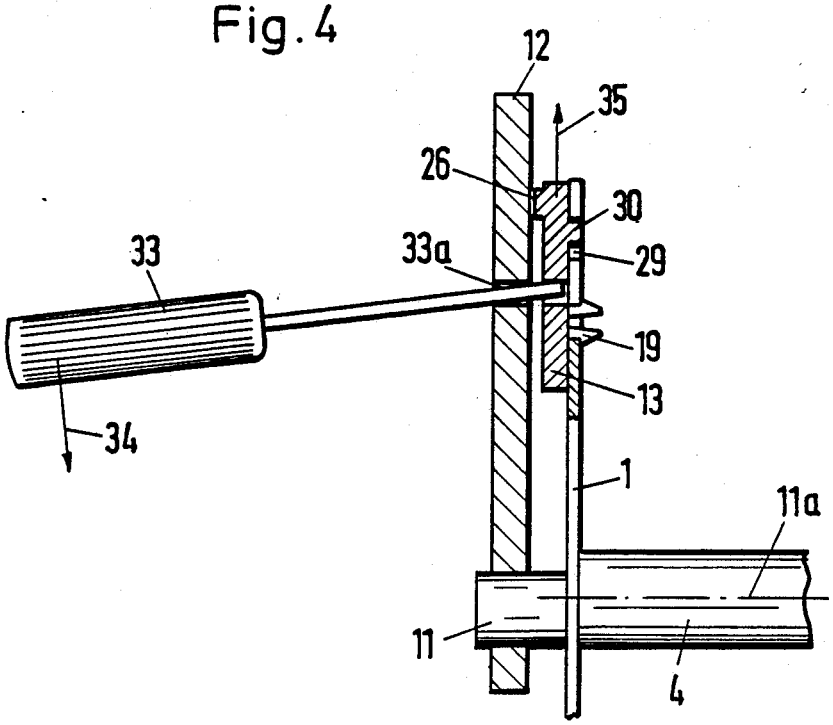
FIG. 4 illustrates, in vertical section, a detail of the adjustment process for obtaining the basic setting of minimum print head to platen spacing.
Figure 5:
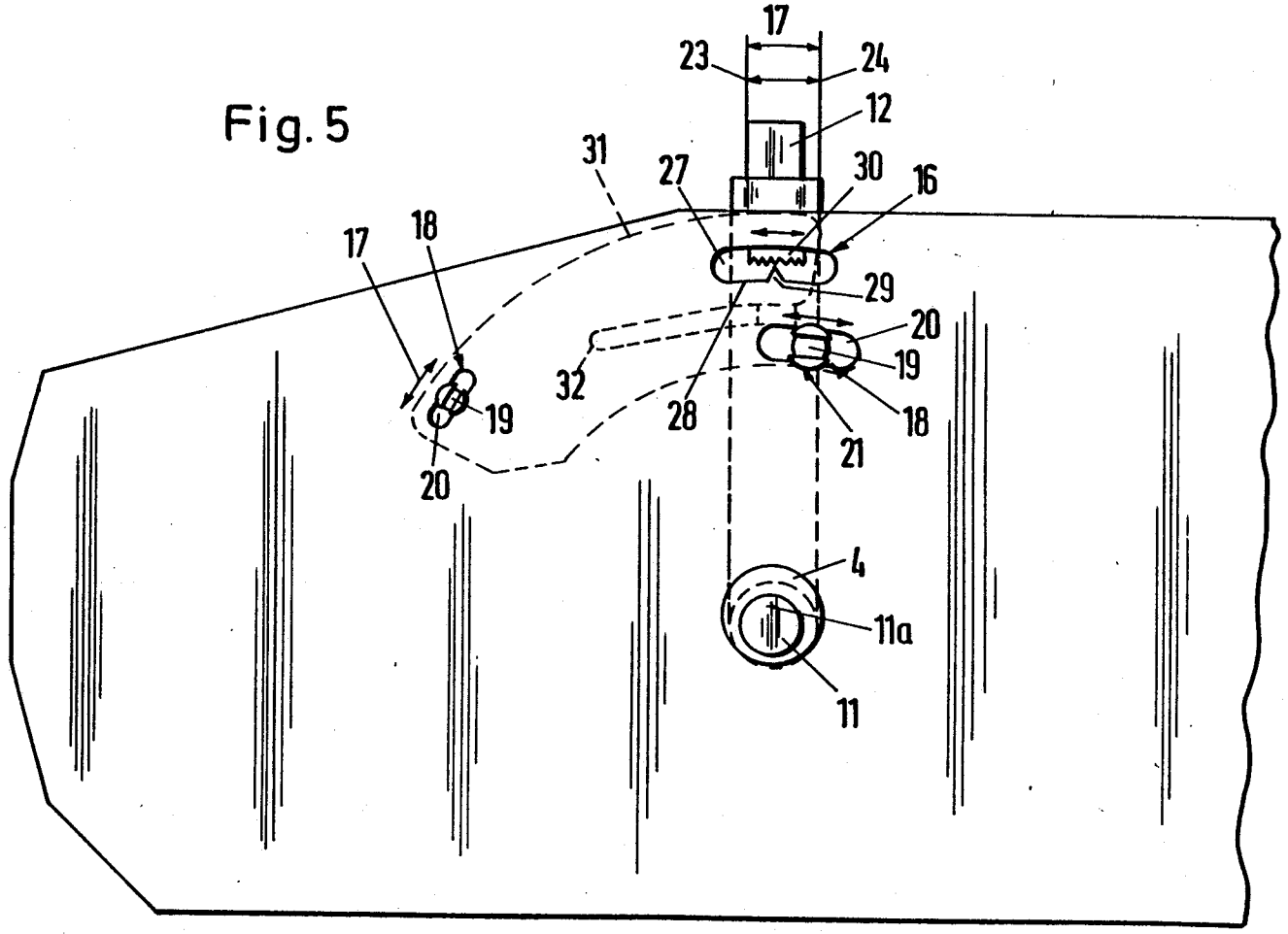
FIG. 5 is a right-hand side view of a sideplate of the printer frame, including a lock for retaining the basic setting adjustment.

The front carriage guide shaft 4 is supported at each of the sideplates 1,2 by an eccentric 11 (FIG. 2). To the eccentrics 11 is fixedly secured a setting or user-operable spacing adjustment lever 12 so that rotation of the setting lever, as hereinafter described, carries the eccentrics 11 through a corresponding rotation therewith. A detent plate 13 is fastened to the wall surface of sideplate 1 (or 2) intermediate the sideplate and setting lever 12 (FIG. 4). The detent plate 13 may conveniently be fabricated as a single-piece element of injection-molded plastic, in which case a rear stop 14 and a front stop 15 may, for example, be unitarily defined as projections from the surface of the detent plate. As illustrated in FIG. 5, the detent plate is arranged for a predetermined range of relative movement, over a short distance or acute angle 17, on and along the supporting sideplate 1 (or 2). More particularly, the detent plate 13 is secured to the sideplate 1 by guides 18, each of which is formed by an elongated slot 20 defined in the sideplate and at least a pin 19 projecting outwardly from the detent plate and receivable in the slot 20. In a currently preferred form of the invention, the pins 19 are appropriately configured at their free ends to form spring-acting pressure pins 21 enabling securement of the detent plate 13 to the sideplate 1 by pressing the pins 19 into and through the slots 20. As should be apparent, the guides 18 permit the above-noted relative movability—substantially along a circumference centered at the horizontal axis 11*a* of the carriage guide shaft 4—between the detent plate and sideplate. A lock 16, described in further detail below, releasably couples the detent plate 13 to the sideplate 1 (or 2) selectively within the range 17.

The detent plate 13 further includes a plurality of radially-oriented ridges or teeth 22 disposed on the face 25 of the plate 13 immediately adjacent setting lever 12. The setting lever correspondingly carries at least a detent tooth 26 for cooperative engagement with the teeth 22. By this arrangement, the spacing between the printing elements of the print head 7 and the paper-supporting surface of the platen 3 is adjustable for accomodating different paper thicknesses by selectively moving the setting lever 12 in the directions 23, 24. Such movement of the setting lever causes corresponding rotation of the eccentrics whereby the spacing or position of the front carriage guide shaft 4—and therefore of the print head 7—is varied relative to the platen 3. The cooperative engagement of the setting lever detent tooth 26 with the teeth or ridges 22 on the detent plate 13 provides readily adjustable "click-stop" retention of the selected spacing between the print head 7 and platen 3. The rear and front stops 14, 15 define the limits of movement of the setting lever 12 in the directions 23, 24, respectively and, therefore, the spacing adjustment available to the user to conform to the thickness of paper being used in the printer. To enable the printer to accomodate a wide range of different paper thicknesses, the ridges or teeth 22 preferably extend over or along a substantial portion of the detent plate 13.

Figure 3:
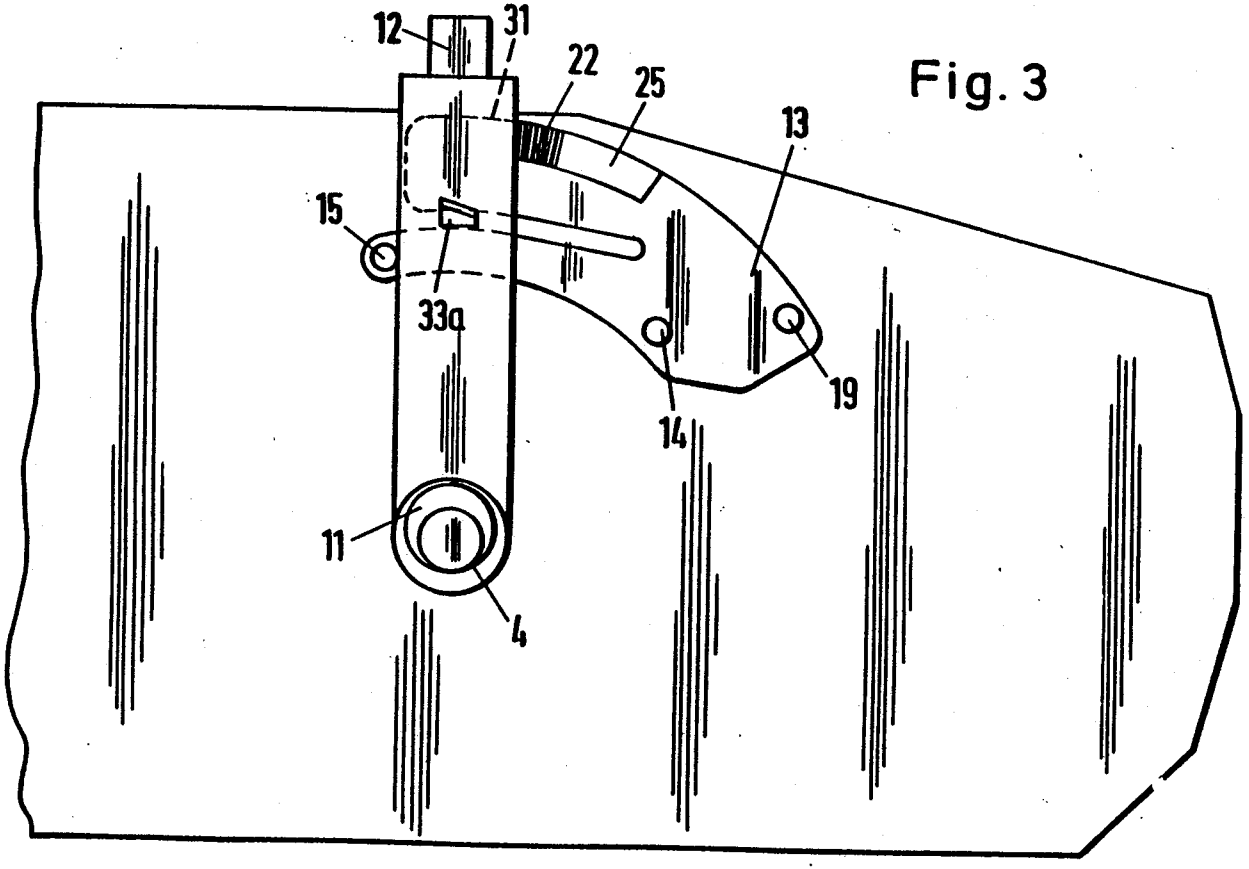
FIG. 3 is a left-hand side view of a portion of the printer frame, shown in the same scale as FIG. 2.

Lock 16 is formed of cooperating elements on the detent plate 13 and supporting sideplate 1 (or 2). For this purpose, the sideplate includes a slot or opening 27 having an edge 28 on which an inwardly projecting tooth 29 is formed. A plurality of mating teeth or toothing 30 are defined on a spring-loaded lever part or arm 31 of the detent plate 13, the spring action thereof being provided by an elongated slot 32 in the detent plate which separates the lever arm 31 from the remainder of the sideplate-supported detent plate 13. The sidewall 1 (or 2) also includes an adjustment opening 33*a* (FIG. 3) substantially aligned with the position of the detent plate slot 32.

The method of setting the minimum print head to platen spacing or basic distance 10 will now be described. As should be apparent, the basic distance 10 is set by adjusting the cooperative interengagement of the elements of lock 16 and, thereby, the relative position of the detent plate 13 on its supporting sideplate 1 (or 2). To effectuate this adjustment in accordance with the invention, and referring to FIG. 4, the blade end of a screwdriver 33 or the like is inserted through an opening 33*a* in the setting lever 12 and through the elongated slot 32 in detent plate 13 into, if desired, substantial abutment against the sideplate 1. The handle end of the screwdriver 33 is then moved in the direction 34, thereby pivotting its blade at setting lever 12 and causing the lever arm 31 of the detent plate 13 to be raised or lifted in the direction 35. As the lever arm 31 is so raised, the mating toothing 30 is carried out of engagement with the sideplate tooth 29 whereby the lock 16 is opened or released and detent plate 13 is rendered relatively movable on the sideplate 1 as heretofore described. Lock 16 is depicted in its opened or released condition in FIGS. 4 and 5. The position of detent plate 13 can now be adjusted in its guides 18 to set the minimum spacing or distance 10 between the print head 7 and platen 3, taking into account the normal operating movement of the print head 7 which, by way of example, may also be a thermal print head, toward and away from the platen. With the relative position of the detent plate on the sideplate appropriately adjusted, return movement of the screwdriver 33 in the direction opposite the arrow 34 causes reengagement of the mating toothing 30 on the detent plate with the sideplate tooth 29, thereby positionally relocking the detent plate to the supporting sideplate. Thus, the adjustment or setting of the minimum spacing or basic distance 10 is effected in a manner which positively and reliably retains the adjustment, which may be performed without the need to partly disassemble the printer or device, and which is entirely independent of the paper-thickness adjustment which is carried out by movement of the setting lever 12.

While there have been shown and described and pointed out fundamental novel features of the invention as applied to a preferred embodiment thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

What is claimed is:

1. A printer, comprising:

a frame;

a platen supported on said frame;

a print head;

a guide shaft for supporting the print head in predeterminately spaced apart relation to said platen and along which the print head is operatively moveable;

means adjustably mounting said guide shaft on said frame for varying the spacing between said print head and platen, said means comprising a user-operable setting lever selectively adjustable for varying said print head-to-platen spacing within a range between a lesser and a greater spacing;

a detent plate on said frame and carrying a front stop and a rear stop, said detent plate being cooperatively associated with said setting lever such that said front and rear stops define said respective lesser and greater spacings by limiting adjustment of said setting lever beyond said front and rear stops; and lock means on said detent plate and frame for positionally securing said detent plate to the frame and releasable for selective adjustment of the position of the detent plate on said frame to set the position of said front stop and, thereby, said lesser spacing to provide a predetermined minimum permissable print head-to-platen spacing beyond which said print head-to-platen spacing is not adjustable by operation of said setting lever, said lock means comprising spring-loaded means on said detent plate for normally resiliently retaining a selected adjustment of the position of the detent plate on said frame and releasable against its normal resilience urgency by which said selected adjustment is retained so as to enable selective adjustment of the position of the detent plate on said frame.

2. A printer in accordance with claim 1, wherein said adjustable mounting means for varying the spacing further comprises an eccentric rotatably mounting said guide shaft to said frame, said setting lever being secured to said eccentric.

3. A printer in accordance with claim 1, wherein said lock means comprises guide means for securing said detent plate to said frame and enabling relative positional adjustment of said detent plate on said frame in the released condition of said lock means.

4. A printer in accordance with claim 3, wherein said lock means further comprises first tooth means on said detent plate and second tooth means on said frame for cooperative interengagement to positionally secure said detent plate to the frame and thereby define said minimum permissable spacing, and releasable for selective adjustment of the position of said detent plate on the frame.

5. A printer in accordance with claim 1, wherein said lock means comprises first tooth means on said detent plate and second tooth means on said frame for cooperative interengagement to positionally secure said detent plate to the frame and thereby define said minimum permissable spacing, and releasable for selective adjustment of the position of said detent plate on the frame.

6. A printer in accordance with claim 3, wherein said guide means comprises means for providing a snap fit securement of said detent plate on said frame.

7. A printer in accordance with claim 1, wherein said detent plate includes a toothing, and said setting lever includes at least a detent tooth, said toothing and detent tooth being releaseably engageable for retaining a selected user adjustment of said setting lever to provide a selected print head-to-platen spacing within said range.

8. A printer in accordance with claim 3, wherein said detent plate includes a toothing, and said setting lever includes at least a detent tooth, said toothing and detent tooth being releaseably engageable for retaining a selected user adjustment of said setting lever to provide a selected print head-to-platen spacing within said range.

9. A printer in accordance with claim 4, wherein said detent plate includes a toothing, and said setting lever includes at least a detent tooth, said toothing and detent tooth being releaseably engageable for retaining a selected user adjustment of said setting lever to provide a selected print head-to-platen spacing within said range.

10. A printer in accordance with claim 1, wherein said spring-loaded means comprises a first portion of said detent plat that is resiliently movable relative to a second portion of said detent plate.

11. A printer in accordance with claim 10, wherein said first portion comprises a lever arm resiliently movable relative to said second portion, and said detent plate is secured to said frame at said second portion of the detent plate.

12. A printer in accordance with claim 10, wherein said lock means further comprises first tooth means on said first portion of said detent plate and second tooth means on said frame for cooperative interengagement to positionally secure said detent plate to the frame and thereby define said minimum permissible spacing.

13. A printer in accordance with claim 10, wherein said first and second portions unitarily comprise said detent plate and are at least partly spaced apart by a slot defined in said detent plate.

14. A printer in accordance with claim 10, wherein said detent plate includes a toothing on said first part, and said setting lever includes at least a detent tooth, said toothing and detent tooth being releasably adjustable for retaining a selected user adjustment of said setting lever to provide a selected print head-to-platen spacing within said range.

* * * * *